US005553194A

United States Patent [19]

Seza et al.

[11] Patent Number: 5,553,194

[45] Date of Patent: Sep. 3, 1996

[54] CODE-BOOK DRIVEN VOCODER DEVICE WITH VOICE SOURCE GENERATOR

[75] Inventors: Katsushi Seza; Hirohisa Tasaki; Kunio Nakajima, all of Kamakura, Japan

[73] Assignee: Mitsubishi Denki Kabushiki Kaisha, Tokyo, Japan

[21] Appl. No.: 951,727

[22] Filed: Sep. 25, 1992

[30] Foreign Application Priority Data

Sep. 25, 1991 [JP] Japan ..... 3-245666
Mar. 11, 1992 [JP] Japan ..... 4-087849

[51] Int. Cl.[6] ..... G10L 9/00

[52] U.S. Cl. ..... 395/2.3; 395/2.28; 395/2.29

[58] Field of Search ..... 381/38, 53; 395/2.28, 395/2.29, 2.3, 2.32

[56] References Cited

U.S. PATENT DOCUMENTS

| | | | |
|---|---|---|---|
| 4,985,923 | 1/1991 | Ichikowa et al. | 381/38 |
| 5,138,662 | 8/1992 | Amono et al. | 381/38 |
| 5,305,332 | 4/1994 | Ozowa | 395/2.32 |

OTHER PUBLICATIONS

International Conference on Acoustics Speech & Signal Processing May 14, 1991 Toronto Canada pp. 481–484.
Eurospeech 89, European Conference on Speech Communication Sep., 1989, Paris, France pp. 27–30.
M. Ljunggvist & H. Fujisaki O "A Method of Estimating ARMA Parameters of Speech Using . . . " Reports . . . vol. 86 pp. 39–45 1986.
A. Bergstrom & P. Hedeline "Code–Book Driven Glottal Pulse Analysis", IEEE ICASSP '89 pp. 53–36, 1989.
Y. M. Cheng & D. O'Shanghnessy, "A 450 BP5 Vocoder with Natural–Sounding Speech", IEEE ICASSP '90 pp. 649–652, 1990.
Kailath, "Modern Signal Processing", 1985 pp. 140–142.
Akamine et al, "ARMA Based Speech Coding at 8 Kb/s", 1989 Acoustics, Speech & Signal Processing Conf, May 23–26 1989, pp. 148–151 vol. 1.

*Primary Examiner*—Allen R. MacDonald
*Assistant Examiner*—Thomas Onka
*Attorney, Agent, or Firm*—Wolf, Greenfield & Sacks, P.C.

[57] ABSTRACT

The encoder unit of the vocoder device includes the AR code-book, the MA code-book, and the voice source code-book storing code words each corresponding to a set of the AR, the MA, and the voice source parameters, respectively, which are obtained beforehand by means of the "analysis by synthesis" of a multitude of speech waveform examples and then clustering the resulting respective parameters. The AR preliminary selector, the MA preliminary selector, and the voice source preliminary selector select from respective code-books a predetermined finite number of code words approximating the input speech signal, and in synchronism with the voice source position detected by the voice source position detector the speech synthesizer synthesizes a number of synthesized speech waveforms corresponding to the combinations of the selected AR, MA, and voice source parameters. Comparing the synthesized speech waveforms with the current input speech signal waveform, the optimal code word selector selects the combination of the AR, the MA, and the voice source code words having a minimum distance to the input speech signal waveform.

19 Claims, 11 Drawing Sheets

CODE-BOOK DRIVEN VOCODER DEVICE WITH VOICE SOURCE GENERATOR

BACKGROUND OF THE INVENTION

This invention relates to vocoder devices for encoding and decoding speech signals for the purpose of digital signal transmission or storage, and more particularly to code-book driven vocoder devices provided with a voice source generator which are suitable to be used as component parts of on-board telephone equipment for automobiles.

A vocoder device provided with a voice source generator using a waveform model is disclosed, for example, in an article by Mats Ljungqvist and Hiroya Fujisaki: "A Method for Estimating ARMA Parameters of Speech Using a Waveform Model of the Voice Source," Journal of Institute of Electronics and Communication Engineers of Japan, Vol. 86, No. 195, SP 86-49, pp. 39–45, 1986, where AR and MA parameters are used as spectral parameters of the speech signal and a waveform model of the voice source is defined as the derivative of a glottal flow waveform.

This article uses the ARMA (auto-regressive moving-average) model of the vocal tract, according to which the speech signal s(n), the voice source waveform (glottal flow derivative) g(n), and the error e(n) are related to each other by means of AR parameters $a_i$ and MA parameters $b_j$:

$$s(n)-\sum_{i=1}^{p} a_i s(n-i)=\sum_{j=0}^{q} b_j g(n-j)+e(n) \quad (1)$$

The model waveform of the voice source g(n) (glottal flow derivative) is shown in FIG. 9, where A is the slope at glottal opening; B is the slope prior to closure; C is the slope following closure; D is the glottal closure timing; W (=R+F) is the pulse width; and T is the fundamental period (pitch period). The voice source waveform g(n) is expressed using these voice source parameters as follows:

$$g(n)=A-\frac{(2A+R\alpha)n}{R}+\frac{(A+R\alpha)n^2}{R} \quad (0 \leqq n \leqq R)$$

$$g(n)=\alpha(n-R)+\frac{(3B-2F\alpha)(n-R)^2}{F^2}-\frac{(2B-F\alpha)(n-R)^3}{F^3} \quad (R>n \geqq W)$$

$$g(n)=C-\frac{2(C-\beta)(n-W)}{D}+\frac{(C-\beta)(n-W)^2}{D^2} \quad (W<n \leqq W+D)$$

$$g(n)=\beta$$

where n represents the time and α and β are:

$$\alpha=(4AR-6FB)/(F^2-2R^2)$$

$$\beta=CD/\{D-3(T-W)\}$$

FIG. 8*a* is a block diagram showing the structure of a speech analyzer unit of a conventional vocoder which operates in accordance with the method disclosed in the above article. A voice source generator 12 generates voice source waveforms 13 corresponding to the glottal flow derivative g(n), the first instance of which is selected arbitrarily. The instances of the voice source waveforms 13 are successively modified with a small perturbation as described below. In response to the input speech signal 1 corresponding to s(n) and the voice source waveforms 13 corresponding to g(n), an ARMA analyzer 44 determines the AR parameters 45 and MA parameters 46 corresponding to the $a_i$'s and $b_j$'s, respectively. Further, in response to the voice source waveforms 13, the AR parameters 45 and the MA parameters 46, a speech synthesizer 19 produces a synthesized speech waveforms 20. Then a distance evaluator 47 evaluates the distance E1 between the input speech signal 1 and the synthesized speech waveforms 20 by calculating the squared error:

$$E1=\sum_{k=1}^{N} e^2(n) \quad (2)$$

When the distance E1 is greater than a predetermined threshold value E0, one of the voice source parameters is given a small perturbation and the voice source parameters 48 are fed back to the voice source generator 12. In response thereto, the voice source generator 12 generates a new instance of the voice source waveform 13 in accordance with the perturbed voice source parameters, and the ARMA analyzer 44 generates new sets of AR parameters 45 and MA parameters 46 on the basis thereof, such that the speech synthesizer 19 produces a slightly modified synthesized speech waveforms 20.

The above operations are repeated, where the magnitude of perturbation given to the voice source parameters are successively reduced. When the distance or error E1 finally becomes less than the threshold level E0, the voice source parameters 48, the AR parameters 49 and the MA parameters 50 encoding the input speech signal 1 are output from the distance evaluator 47.

FIG. 8*b* is a block diagram showing the structure of a speech synthesizer unit of a conventional vocoder which synthesizes the speech from the voice source parameters 48, AR parameters 49 and the MA parameters 50 output from the analyzer of FIG. 8*a*. In response to the voice source parameters 48, a voice source generator 40 generates a voice source waveform 41. Further, a speech synthesizer 42 generates a synthesized speech 43 on the basis of the voice source waveform 41, the AR parameters 49 and the MA parameters 50.

The above conventional vocoder device, however, has the following disadvantage. For each set of voice source parameters, the spectral parameters (i.e., the AR and the MA parameters) are calculated to produce a synthesized speech waveforms 20, such that the distance or squared error E1 between the input speech signal 1 and the synthesized speech waveforms 20 is determined. The voice source parameters are perturbed and the synthesis of the speech and the determination of the error E1 between the original and the synthesized speech are repeated until the error E1 finally becomes less than a threshold level E0. Since the spectral parameters and the voice source parameters are determined successively by the method of "analysis by synthesis," the calculation is quite complex. Further, the procedure for determining the parameters may become unstable.

Furthermore, since the speech signal is processed in synchronism with the pitch period, a fixed or a low bit rate encoding of the speech signal is difficult to realize.

SUMMARY OF THE INVENTION

It is therefore a primary object of this invention to provide a vocoder device for encoding and decoding speech signals by which the complexity of the calculations of the spectral and voice source parameters is reduced and the procedure for the determining the parameters is stabilized, such that a high quality synthesized speech is produced. Further, this invention aims at providing a vocoder device by which a fixed and low bit rate encoding of the speech signal is realized. Furthermore, this invention aims at providing such a vocoder device capable of reproducing the input speech over a wide range of the pitch period length thereof.

The above primary object is accomplished in accordance with the principle of this invention by a vocoder device for encoding and decoding speech signals, which comprises:

an encoder unit for encoding an input speech signal including: (a) a first spectral code-book storing a plurality of spectral code words each corresponding to a set of spectral parameters and identified by a spectral code word identification number; (b) a first voice source code-book storing a plurality of voice source code words each representing a voice source waveform over a pitch period and identified by a voice source code word identification number; (c) voice source generator means for generating voice source waveforms for each pitch period on the basis of the voice source code words; (d) speech synthesizer means for producing synthesized speech waveforms for respective combinations of the spectral code words and the voice source code words in response to the spectral code words and the voice source waveforms; (e) optimal code word selector means for selecting a combination of a spectral code word and a voice source code word corresponding to a synthesized speech waveform having a smallest distance to the input speech signal, the optimal code word selector means outputting the spectral code word identification number and the voice source code word identification number corresponding to the spectral code word and the voice source code word, respectively, of the combination selected by the optimal code word selector means; and a decoder unit for reproducing a synthesized speech from each combination of the spectral code word and the voice source code word encoding the input speech signal, the decoder unit including: (f) a second spectral code-book identical to the first spectral code-book; (g) a second voice source code-book identical to the first voice source code-book; (h) spectral inverse quantizer means for selecting from the second spectral code-book a spectral code word corresponding to the spectral code word identification number; (i) voice source inverse quantizer means for selecting from the voice source code-book a voice source code word corresponding to the voice source code word identification number; (j) voice source generator means for generating a voice source waveform for each pitch period on the basis of the voice source code word selected by the voice source inverse quantizer; and (k) speech synthesizer means for producing a synthesized speech waveform on the basis of the spectral code word selected by the spectral inverse quantizer means and the voice source waveform generated by the voice source generator means.

More specifically, it is preferred that the vocoder device comprises:

an encoder unit for encoding an input speech signal, including: spectrum analyzer means for analyzing the input speech signal and successively extracting therefrom a set of spectral parameters corresponding to a current spectrum of the input speech signal; a first spectral code-book storing a plurality of spectral code words each consisting of a set of spectral parameters and a spectral code word identification number corresponding thereto; spectral preliminary selector means for selecting from the spectral code-book a finite number of spectral code words representing sets of spectral parameters having smallest distances to the set of spectral parameters extracted by the spectrum analyzer means; a first voice source code-book storing a plurality of voice source code words each consisting of a set of voice source parameters representing a voice source waveform over a pitch period and a voice source code word identification number corresponding thereto; a voice source preliminary selector for selecting a finite number of voice source code words having a smallest distance to a voice source code word selected previously; voice source generator means for generating voice source waveforms for each pitch period on the basis of the voice source code words selected by the voice source preliminary selector; speech synthesizer means for producing synthesized speech waveforms for respective combinations of the spectral code words and the voice source code word; optimal code word selector means for comparing the synthesized speech waveforms with the input speech signal, the optimal code word selector selecting a combination of a spectral code word and a voice source code word corresponding to a synthesized speech waveform having a smallest distance to the input speech signal, wherein the optimal code word selector outputting a combination of a spectral code word identification number corresponding to the spectral code word and a voice source code word identification number corresponding to the voice source code word, the combination of the spectral code word identification number and the voice source code word identification number encoding the input speech signal; and a decoder unit for reproducing a synthesized speech from each combination of the spectral code word identification number and the voice source code word identification number encoding the input speech signal, the decoder unit including: a second spectral code-book storing a plurality of spectral code words each consisting of a set of spectral parameters and a spectral code word identification number corresponding thereto, the second spectral code-book being identical to the first spectral code-book; a second voice source code-book storing a plurality of voice source code words each consisting of a set of voice source parameters representing a voice source waveform over a pitch period and a voice source code word corresponding thereto, the second voice source code-book being identical to the first voice source code-book; spectral inverse quantizer means for selecting from the second spectral code-book a spectral code word corresponding to the identification number; voice source inverse quantizer means for selecting from the voice source code-book a voice source code word corresponding to the identification number; voice source generator means for generating a voice source waveform for each pitch period on the basis of the voice source code word selected by the voice source inverse quantizer; and speech synthesizer means for producing synthesized speech waveforms on the basis of the spectral code word selected by the spectral inverse quantizer means and the voice source waveform generated by the voice source generator means.

Preferably, the spectrum analyzer means extracts a set of the spectral parameters for each analysis frame of predetermined time length longer than the pitch period; and the encoder unit further includes voice source position detector means for detecting a start point of the voice source waveform for each pitch period and outputting the start point as a voice source position; the voice source generator means generating the voice source waveforms in synchronism with the voice source position output from the voice source position detector means for each pitch period; the optimal code word selector means selecting a combination of the spectral code word and the voice source code word which minimizes the distance between the voice source position detector and the input speech signal over a length of time including pitch periods extended over a current frame and a preceding and a succeeding frame; and the decoder unit further includes: spectral interpolator means for outputting interpolated spectral parameters interpolating for each pitch period the spectral parameters of the spectral code words of current and preceding frames; voice source interpolator means for outputting interpolated voice source parameters interpolating for each pitch period the voice source parameters of the voice source code words of current and preceding frames; wherein the voice source generator generates the voice source waveform for each pitch period on the basis of the interpolated voice source parameters, and the speech synthesizer means producing the synthesized speech waveform for each pitch period on the basis of the interpolated spectral parameters and the voice source waveform output from the voice source generator.

Further, according to this invention, a method is provided for generating a voice source waveform g(n) for each pitch period on the basis of predetermined parameters: A, B, C, $L_1$, $L_2$, and pitch period T:

$$g(n) = An - Bn^2 \text{ (for } 0 \leqq n \leqq L_1)$$
$$g(n) = C\,(n - L_2)^2 \text{ (for } L_1 < n \leqq L_2)$$
$$g(n) = 0 \text{ (for } L_2 < n \leqq T)$$

where n represents time.

Furthermore, it is preferred that the encoder unit further includes: (1) pitch period extractor means for determining a pitch period length of the input speech signal; (m) order determiner means for determining an order in accordance with the pitch period length; and (n) first converter means for converting the spectral code words into corresponding spectral parameters, the spectral code words each consisting of a set spectral envelope parameters corresponding to a set of the spectral parameters; and the decoder unit further includes: (o) second converter means for converting the spectral code word retrieved by the spectral inverse quantizer means from the second spectral code-book into a set of corresponding spectral parameters of an order equal to the order determined by the order determiner of the encoder unit.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

FIG. *6a* is a block diagram showing the structure of the encoder unit of another vocoder device according this invention;

FIG. *6b* is a block diagram showing the structure of the decoder unit coupled with the encoder unit of FIG. *6a;*

FIG. *7a* is a block diagram showing the structure of the encoder unit of still another vocoder device according to this invention;

FIG. *7b* is a block diagram showing the structure of the decoder unit coupled with the encoder unit of FIG. *7a;*

Figure 9:
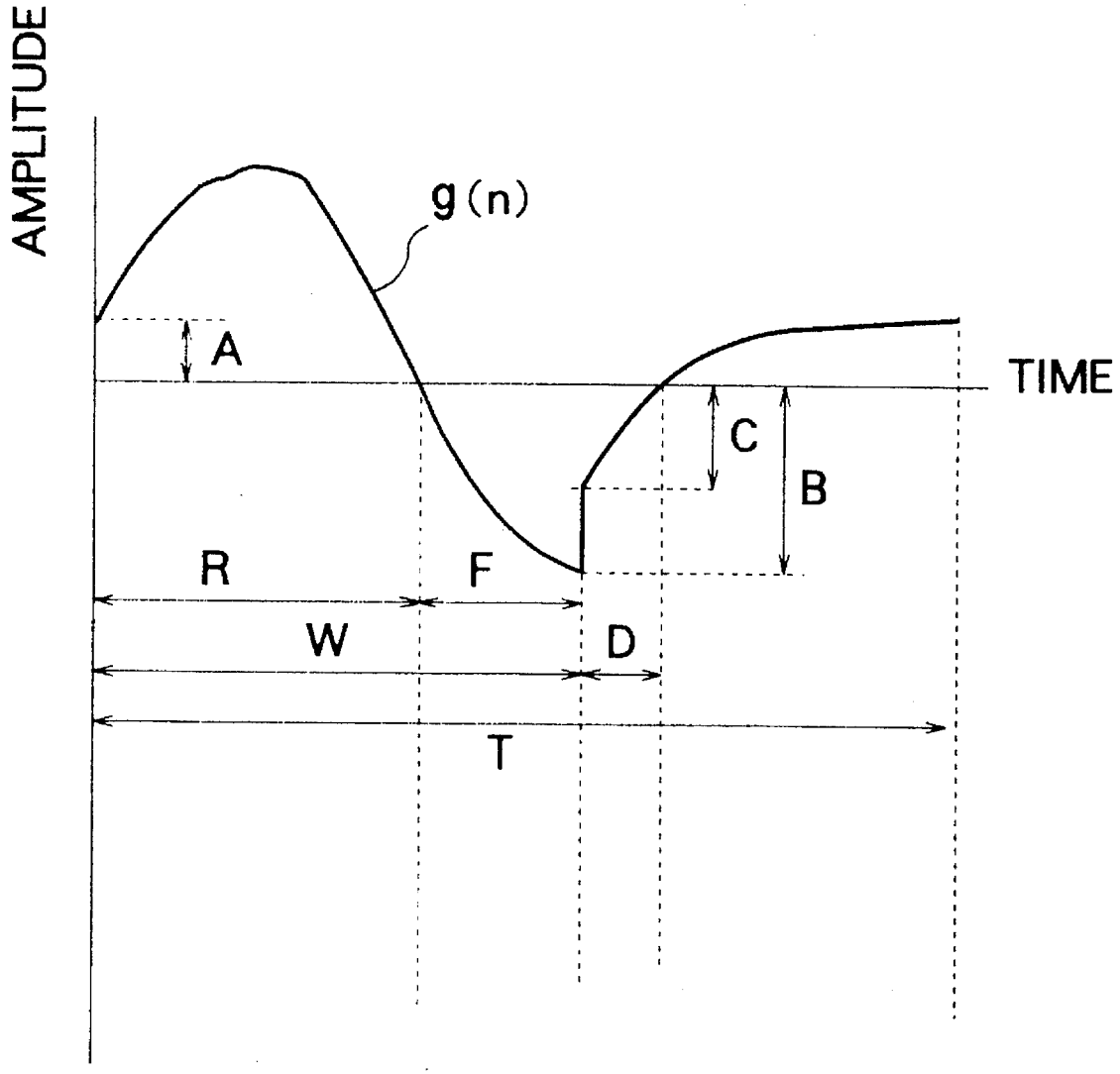
FIG. 9 (PRIOR ART)

FIG. *8a* is a block diagram showing the structure of a speech analyzer unit of a conventional vocoder;

FIG. *8b* is a block diagram showing the structure of a speech synthesizer unit of a conventional vocoder; and FIG. 9 shows the voice source waveform model (the glottal flow derivative) used in the conventional device of FIGS. *8a* and *8b*.

In the drawings, like reference numerals represent like or corresponding parts or portions.

DETAILED DESCRIPTION OF THE PREFERRED EMBODIMENTS

Referring now to the accompanying drawings, the preferred embodiments of this invention are described.

Figure 1:
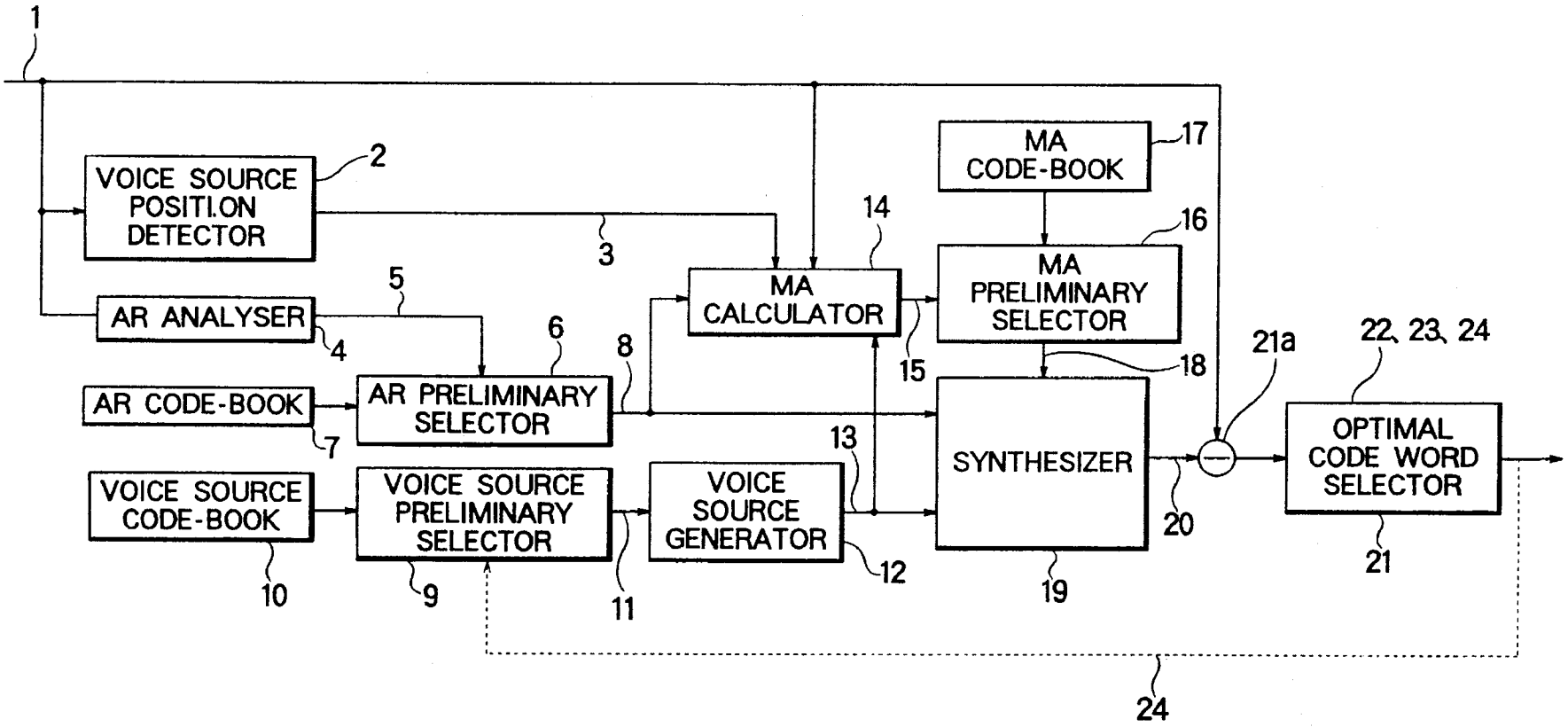
FIG. 1 is a block diagram showing the structure of the encoder unit of a vocoder device according to this invention.

FIG. 1 is a block diagram showing the structure of the encoder unit of a vocoder device according to this invention. Based on the well-known LPC (linear predictive analysis) method, the AR analyzer 4 analyses the input speech signal 1 to obtain the AR parameters 5. The AN parameters 5 thus obtained represent a good approximation of the set of the AR parameters $a_i$'s minimizing the error of the equation (1) above. The AR code-book 7 stores a plurality of AR code words each consisting of a set of the AR parameters and an identification number thereof. An AR preliminary selector 6 selects from the AR code-book 7 a finite number L of AR code words which are closest (i.e., at smallest distance) to the AR parameters 5 output from the AR analyzer 4. The distance between two AR code words, or two sets of the AR parameters, may be measured by the sum of the squares of the differences of the corresponding $a_i$'s. The AR preliminary selector 6 outputs the selected code words as preliminarily selected code words 8, preliminarily selected code words representing sets of AR parameters which are relatively close to the set of the AR parameters determined by the AR analyzer 4. To each one of the preliminarily selected code words 8 output from the AR preliminary selector 6 is attached an identification number thereof within the AR code-book 7.

The analysis of the input speech signal 1 is effected for each frame (time interval), the length of which is greater than that of a pitch period of the input speech signal 1. A voice source position detector 2 detects, for example, the peak position of the LPC residual signal of the input speech signal 1 for each pitch period and outputs it as the voice source position 3.

A voice source code-book 10 stores a plurality of voice source code words each consisting of a set of voice source parameters and an identification number thereof. A voice source preliminary selector 9 selects from the voice source code-book 10 a finite number M of voice source code words which are close (i.e., at smallest distances) to the voice source code word that was selected in the preceding frame. The measure of closeness or the distance between two voice source code words may be a weighted squared distance therebetween, which is the weighted sum of the squares of the differences of the corresponding voice source parameters of the two code words. The voice source preliminary selector 9 outputs the selected voice source code words together with the identification numbers thereof as the preliminarily selected code words 11. Each of the preliminarily selected code words 11 represents a set of voice source parameters corresponding to a voice source waveform over a pitch period. In response to the preliminarily selected code words 11 output from the voice source preliminary selector 9 and the voice source position 3 output from the voice source position detector 2, a voice source generator 12 produces a plurality of voice source waveforms 13 in synchronism with the voice source position 3.

In response to the input speech signal 1, the voice source position 3, the preliminarily selected code words 8, and the voice source waveforms 13, an MA calculator 14 calculates a set of MA parameters 15 which gives a good approximation of the MA parameters $b_j$'s minimizing the error of the equation (1) above.

The MA code-book 17 stores a plurality of AR code words each consisting of a set of the MA parameters and an identification number thereof. An MA preliminary selector 16 selects from the MA code-book 17 a finite number N of MA code words which are closest (i.e., at smallest distances) to the MA parameters 15 determined by the MA calculator 14. The closeness or distance between two sets of the MA parameters may be measured by a squared distance therebetween, which is the sum of the squares of the differences of the corresponding $b_j$'s. The MA preliminary selector 16 outputs the selected code words as preliminarily selected MA code words 18. The preliminarily selected code words represent sets of MA parameters which are relatively close to the set of the MA parameters calculated by the MA calculator 14.

On the basis of the preliminarily selected code words 8, the voice source waveforms 13 and the preliminarily selected MA code words 18, a speech synthesizer 19 produces synthesized speech waveforms 20. As described above, the preliminarily selected code words 8 and the preliminarily selected MA code words 18 includes L and N code words, respectively, and the voice source waveforms 13 includes M voice source waveforms. Thus, the speech synthesizer 19 produces a plurality (equal to L times M times N) of synthesized speech waveforms 20, all in synchronism with the voice source position 3 supplied from the voice source position detector 2. The difference between the input speech signal 1 and each one of the synthesized speech waveforms 20 is calculated by a subtractor 21*a* and is supplied to an optimal code word selector 21 together with the code word identification numbers corresponding to the AR, the MA, and the voice source code words on the basis of which the synthesized waveform is produced. The differences between the input speech signal 1 and the plurality of the synthesized speech waveforms 20 may be supplied to the optimal code word selector 21 in parallel. The optimal code word selector 21 selects the combination of the AR code word, the MA code word, and the voice source code word which minimizes the difference or the error thereof from the input speech signal 1, and outputs the AR code word identification number 22, the MA code word identification number 23, and the voice source code word identification number 24 corresponding to the AR, the MA, and the voice source code words of the selected combination. The combination of the AR code word identification number 22, the MA code word identification number 23, and the voice source code word identification number 24 output from the optimal code word selector 21 encodes the input speech signal 1 in the current frame. The voice source code word identification number 24 is fed back to the voice source preliminary selector 9 to be used in the selection of the voice source code word in the next frame.

Figure 3:
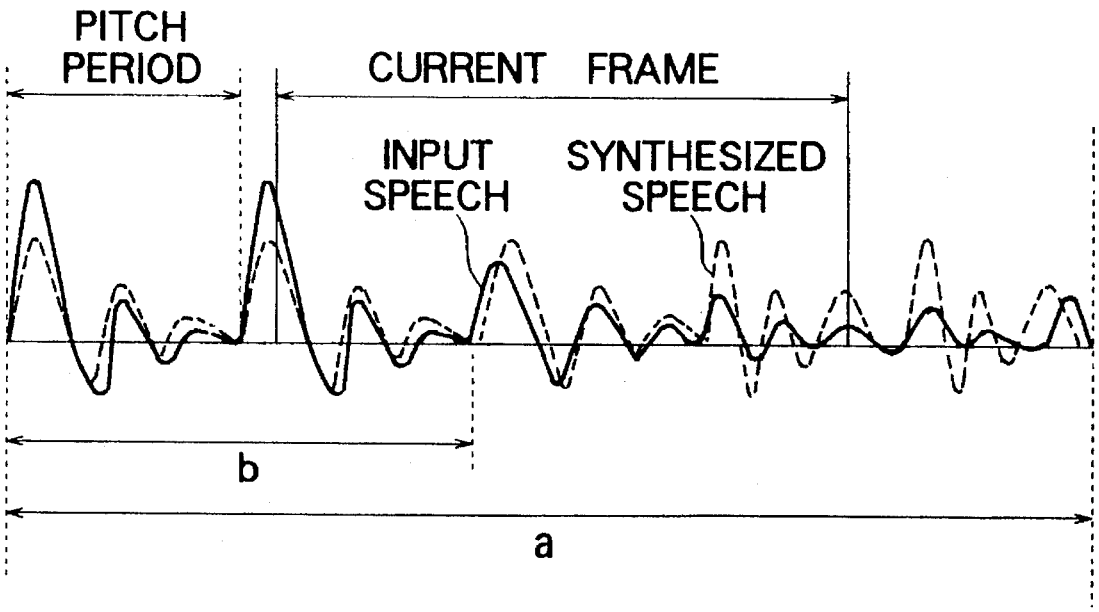
FIG. 3 shows the waveforms of the input and the synthesized speech to illustrate a method of operation of the optimal code word selector of FIG. 1.

FIG. 3 shows the waveforms of the input and the synthesized speech to illustrate a method of operation of the optimal code word selector of FIG. 1. First, the optimal code word selector 21 determines the combination of the AR code word, the MA code word, and the voice source code word which minimizes the distance E1 between the input speech signal 1 (solid line) and the synthesized speech (dotted line) over a distance evaluation interval a which includes several pitch periods before and after the current frame. If the distance E1 is less than a predetermined threshold level E0, then the combination giving the distance E1 is selected and output.

On the other hand, if the distance E1 exceeds the threshold E0, a new distance evaluation interval b (b<a) consisting of several pitch periods within which the input speech signal 1 is at a greater power level is selected, and the combination of the AR code word, the MA code word, and the voice source code word which minimizes the distance between the input speech signal 1 (solid line) and the synthesized speech (dotted line) over the new distance evaluation interval b is selected and output.

By the way, the entries of the AR code-book 7, the voice source code-book 10, and the MA code-book 17 consist of the AR parameters, voice source parameters, and the MA parameters, respectively, which are determined beforehand from a multitude of input speech waveform examples (which are collected for the purpose of preparing the AR code-book 7, the voice source code-book 10, and the MA code-book 17) by means of the "analysis by synthesis" method for respective parameters. For example, the sets of the AR parameters $a_i$'s, the MA parameters $b_j$'s, and the voice source parameters corresponding to the waveform g(n) which give stable solutions of the equation (1) above for each input speech waveform are determined by means of the "analysis by synthesis" method, and then are subjected to a clustering process on the basis of the LBG algorithm to obtain respective code word entries of the AR code-book 7, the voice source code-book 10, and the MA code-book 17, respectively.

Figure 2:
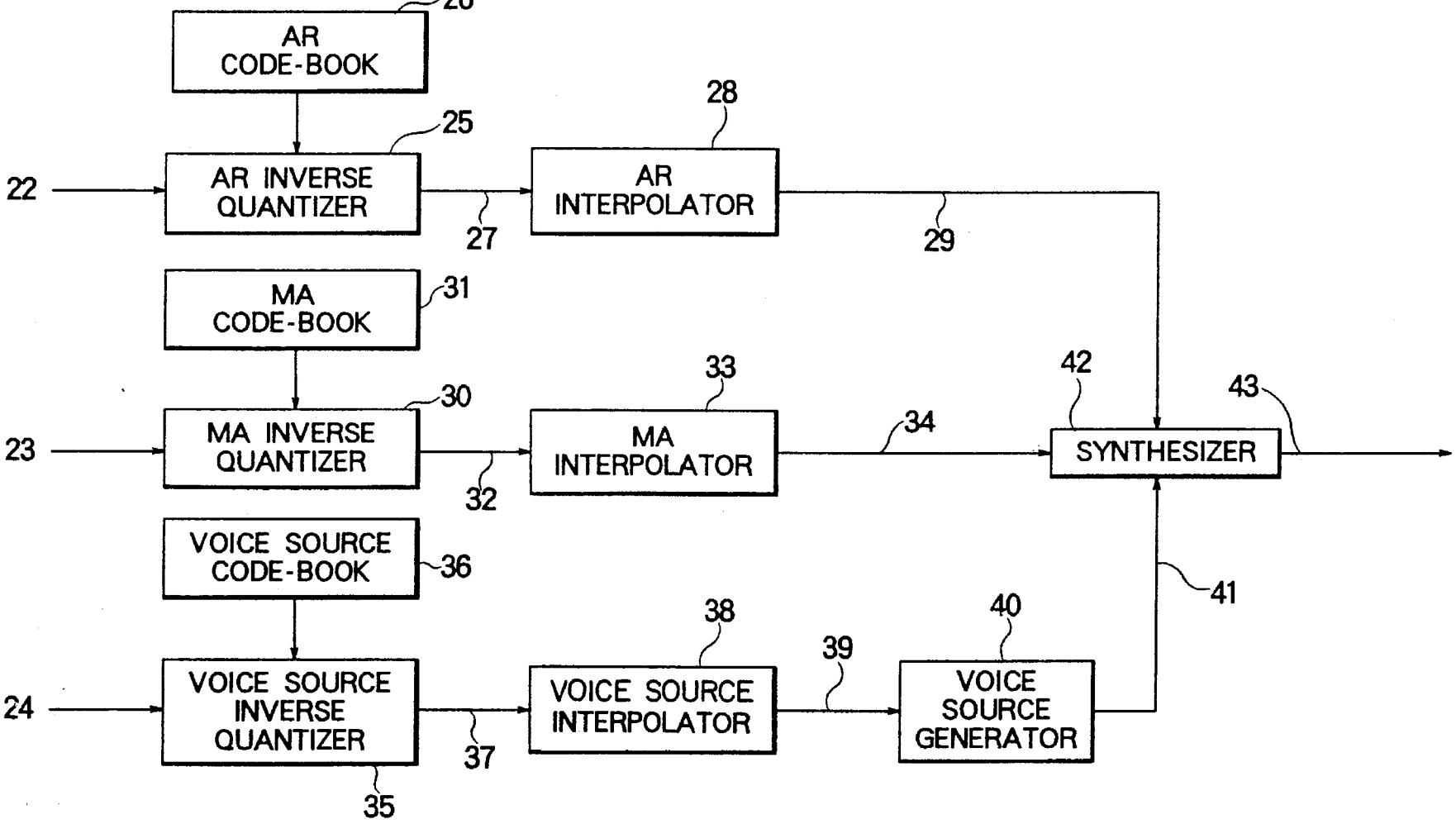
FIG. 2 is a block diagram showing the structure of the decoder unit of a vocoder device according to this invention.

FIG. 2 is a block diagram showing the structure of the decoder unit of a vocoder device according to this invention. The decoder unit decodes the combination of the AR code word identification number 22, the MA code word identification number 23, and the voice source code word identification number 24 supplied from the encoder unit and produces the synthesized speech 43 corresponding to the input speech signal 1.

Upon receiving the AR code word identification number 22, an AR inverse quantizer 25 retrieves the AR code word 27 corresponding to the AR code word identification number 22 from the AR code-book 26, which has identical organization as the AR code-book 7. Further, upon receiving the MA code word identification number 23, an MA inverse quantizer 30 retrieves the MA code word 32 corresponding to the MA code word identification number 23 from the MA code-book 31, which has identical organization as the MA code-book 17. Furthermore, upon receiving the voice source code word identification number 24, a voice source inverse quantizer 35 retrieves the voice source code word 37 corresponding to the voice source code word identification number 24 from the voice source code-book 36, which has identical organization as the voice source code-book 10.

Figure 4:
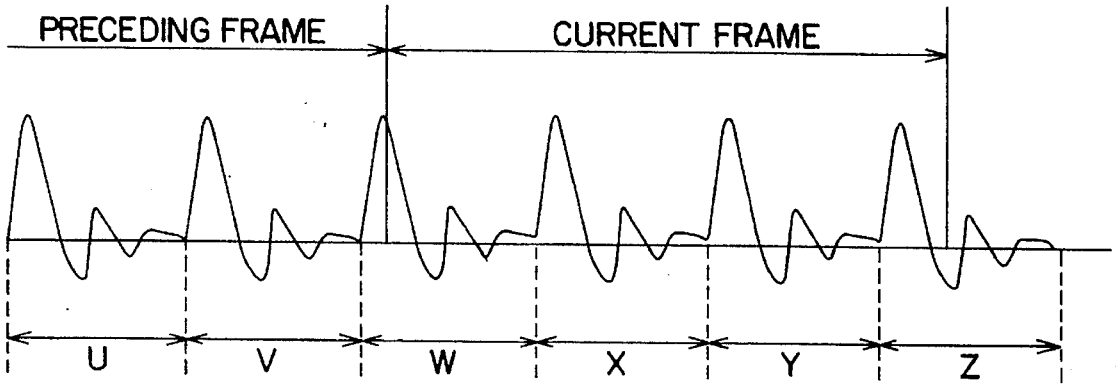
FIG. 4 shows the waveform of synthesized speech to illustrate the method of interpolation within the decoder unit according to this invention.

FIG. 4 shows the waveform of synthesized speech to illustrate the method of interpolation within the decoder unit according to this invention. Each frame includes complete or fractional parts of the pitch periods. For example, the current frame includes complete pitch periods X and Y and fractions of pitch periods W and Z. On the other hand, the preceding frame includes complete pitch periods U and V and a fraction of the pitch period W. The speech is synthesized for each of the pitch periods U, V, W, X, Y, and Z. As described above, however, the combination of the AR, the MA, and the voice source code words which encode the speech waveform is selected for each one of the frame by the optimal code word selector 21 of the encoder unit. Thus, the AR, the MA, and the voice source parameters must be interpolated for all pitch periods (e.g., the pitch periods X and Y in FIG. 4) according to the position of the pitch.

Thus, in response to the AR code word 27, an AR interpolator 28 outputs a set of interpolated AR parameters 29 for each pitch period. The interpolated AR parameters 29 is a linear interpolation of the AR parameters of the preceding and current frame for all pitch periods (e.g., the pitch periods X and Y in the current frame) according to the position of the pitch. However, for the pitch period Y, for example, which is completely included within the current frame, the interpolated AR parameters 29 may be identical with the parameters of the AR code word 27 of the current frame.

Similarly, an MA interpolator 33 outputs a set of interpolated MA parameters 34 for each pitch period. The interpolated MA parameters 34 is a linear interpolation of the MA parameters of the preceding and current frame for all pitch periods according to the position of the pitch period. For the pitch period which is completely included within the current frame, the interpolated MA parameters 34 may be identical with the parameters of the MA code word 32 of the current frame.

Further, a voice source interpolator 38 outputs a set of interpolated voice source parameters 39 for each pitch period. The interpolated voice source parameters 39 is a linear interpolation of the voice source parameters of the preceding and current frame for all pitch periods according to the position of the pitch period. For the pitch period which is completely included within the current frame, the interpolated voice source parameters 39 may be the parameters of the voice source code word 37 of the current frame.

On the basis of the interpolated voice source parameters 39, a voice source generator 40 generates a voice source waveform 41 for each pitch period. Further, on the basis of the interpolated AR parameters 29, the interpolated MA parameters 34, and the voice source waveform 41, a speech synthesizer 42 generates a synthesized speech 43.

As described above, according to this invention, the AR parameters, the MA parameters, and the voice source parameters are interpolated for all pitch periods according to the position of the pitch period, such that in effect the speech is synthesized in synchronism with the frames that generally includes a plurality of pitch periods. Thus, a low and fixed bit rate encoding of speech can be realized.

Figure 5:
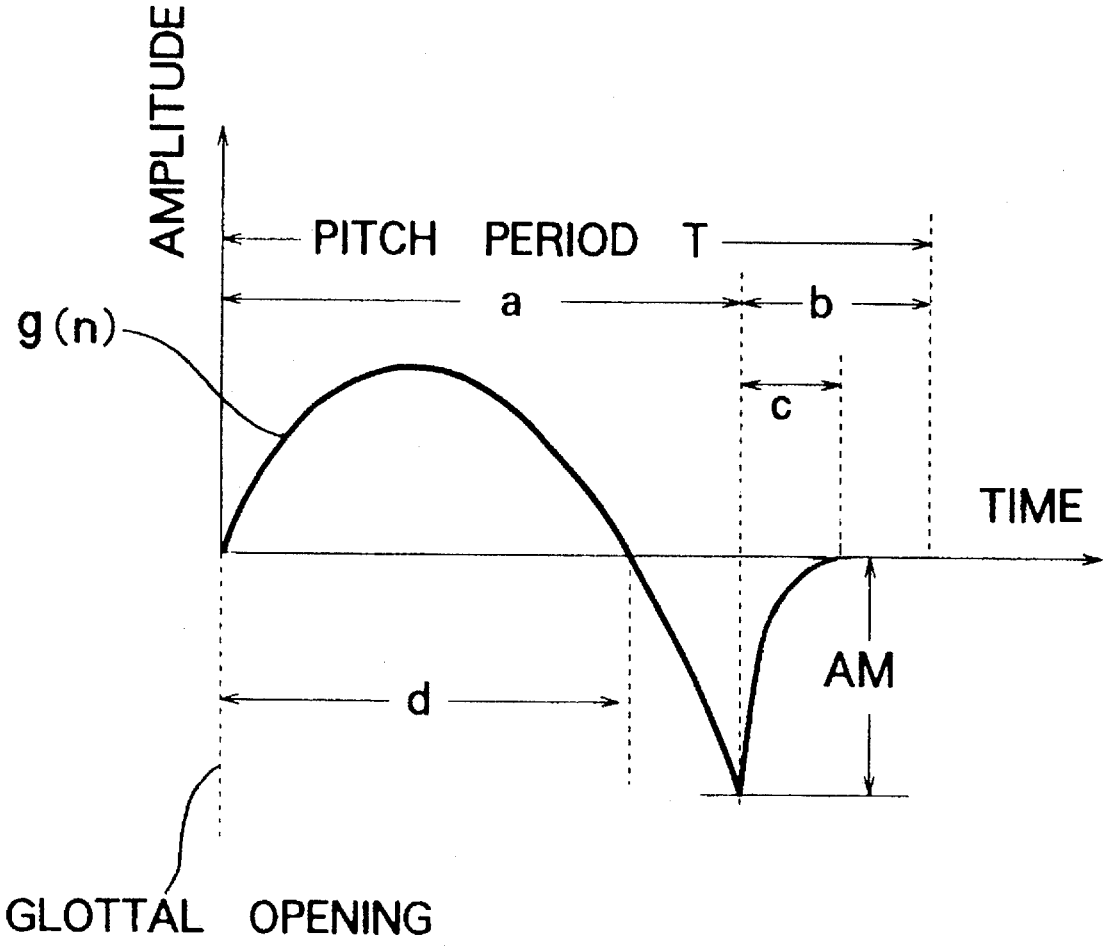
FIG. 5 shows the voice source waveform model used in the vocoder device according to this invention.

FIG. 5 shows the voice source waveform model used in the vocoder device according to this invention. The voice source waveform may be generated by the voice source generator 12 of FIG. 1 and the voice source generator 40 of FIG. 2 on the basis of the voice source parameters. The voice source waveform g(n), defined as the glottal flow derivative, is plotted against time shown along the abscissa and the amplitude (the time derivative of the glottal flow) shown along the ordinate. The interval a represents the time interval from the glottal opening to the minimal point of the voice source waveform. The interval b represents the time interval within the pitch period T after the interval a. The interval c represents the time interval from the minimal point to the subsequent zero-crossing point. The interval d represents the time interval from the glottal opening to the first subsequent zero-crossing point. Then, the voice source waveform g(n) is expressed by means of five voice source parameters: the pitch period T, amplitude AM, the ratio OQ of the interval a to the pitch period T, the ratio OP of the interval d to the interval a, and the ratio CT of the interval c to the interval b. Namely, the voice source waveform g(n) as used by the embodiment of FIGS. 1 and 2 is defined by:

$$g(n) = An - Bn^2 \ (0 \leqq n \leqq T \cdot OQ)$$
$$g(n) = C\,(n - L)^2 \ (T \cdot OQ < n \leqq L)$$
$$g(n) = 0 \ (L < \leqq T)$$

where $$A = \frac{AM}{T \cdot OQ \cdot (T \cdot OQ - 1)/OP}$$

$$B = \frac{A}{OQ \cdot T \cdot OP}$$

$$C = -\frac{AM}{(1 - OQ) \cdot T \cdot CT}$$

$$L = T \cdot (1 - OQ) \cdot CT + T \cdot OQ$$

In the case of the above embodiment, a combination of the AR code word, the MA code word, and the voice source code word is selected for each frame. It is possible, however, to select plural combinations of code words for each frame. Further, although the AR and the MA parameters are used as the spectral parameters in the above embodiment, the AR parameters alone may be used as spectral parameters. Furthermore, in the case of the above embodiment, the synthesized speech is produced from the spectral parameters and the voice source parameters. However, it is possible to generate the synthesized speech while interpolating the spectral parameters and the voice source parameters and calculating the distance between the synthesized speech and the input speech signal.

Still further, in the case where the distance between the synthesized speech and the input speech signal is determined to be above an allowable limit by the optimal code word selector 21, the parameters for the current frame may be calculated by interpolation of the spectral parameters and the voice source parameters for the frames preceding and subsequent to the current frame. Still further, in the case of the above embodiment, the voice source code word includes the pitch period T and the amplitude AM. The voice source code-book may be prepared with code word entries which are obtained by clustering the voice source parameters excluding the pitch period T and the amplitude AM. Then the pitch period and the amplitude may be encoded and decoded separately.

Figure 6A:
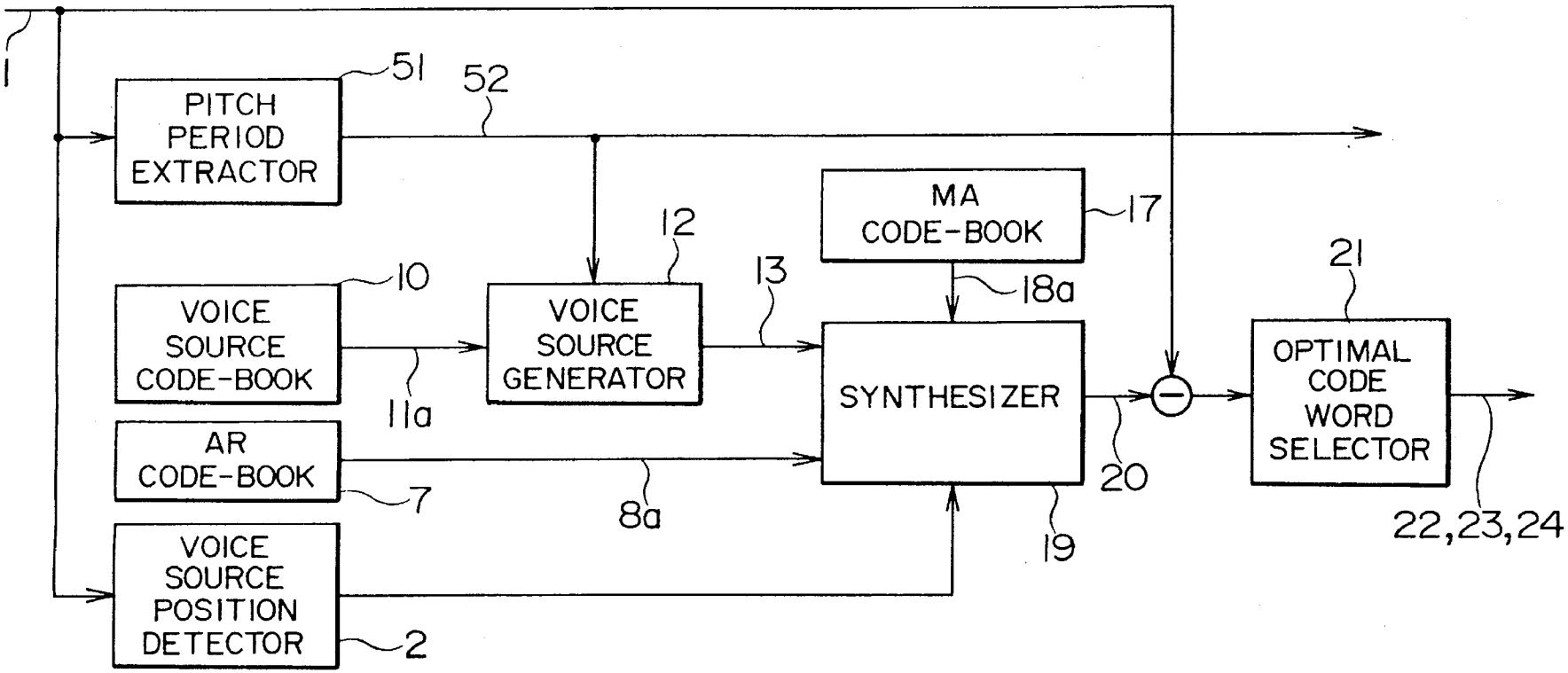

FIG. **6*a* is a block diagram showing the structure of the encoder unit of another vocoder device according to this invention, which is discussed in an article by the present inventors: Seza et al., "Study of Speech Analysis/Synthesis System Using Glottal Voice Source Waveform Model," Lecture Notes of 1991 Fall Convention of Acoustics Association of Japan, I, 1-6-10, pp. 209–210, 1991. The encoder of FIG. 6*a* is similar to that of FIG. 1. However, the encoder unit includes pitch period extractor 51 for detecting the pitch period of the input speech signal 1 and outputs a pitch period length 52 of the input speech signal 1. The voice source code-book 10 of FIG. 6*a* (corresponding to the combination of the voice source code-book 10 and the voice source preliminary selector 9 of FIG. 1) stores a plurality of voice source code words, and outputs the voice source code words 11*a* together with their identification numbers. The MA code-book 17 (corresponding to the combination of the MA calculator 14, the MA preliminary selector 16 and the MA code-book 17 of FIG. 1) stores as the MA code words sets of MA parameters converted into spectral envelope parameters, and outputs these MA code words 18***a* together with the identification numbers thereof. The voice source generator 12 generates the voice source waveforms 13 in response to the pitch period length 52 and the voice source code words 11*a*. The speech synthesizer 19 produces synthesized speech waveforms 20 on the basis of the AR code words 8*a*, the MA code words 18*a*, and the voice source waveforms 13. Otherwise, the structure and method of operation of the encoder of FIG. 6*a* are similar to those of the encoder of FIG. 1.

Figure 6B:
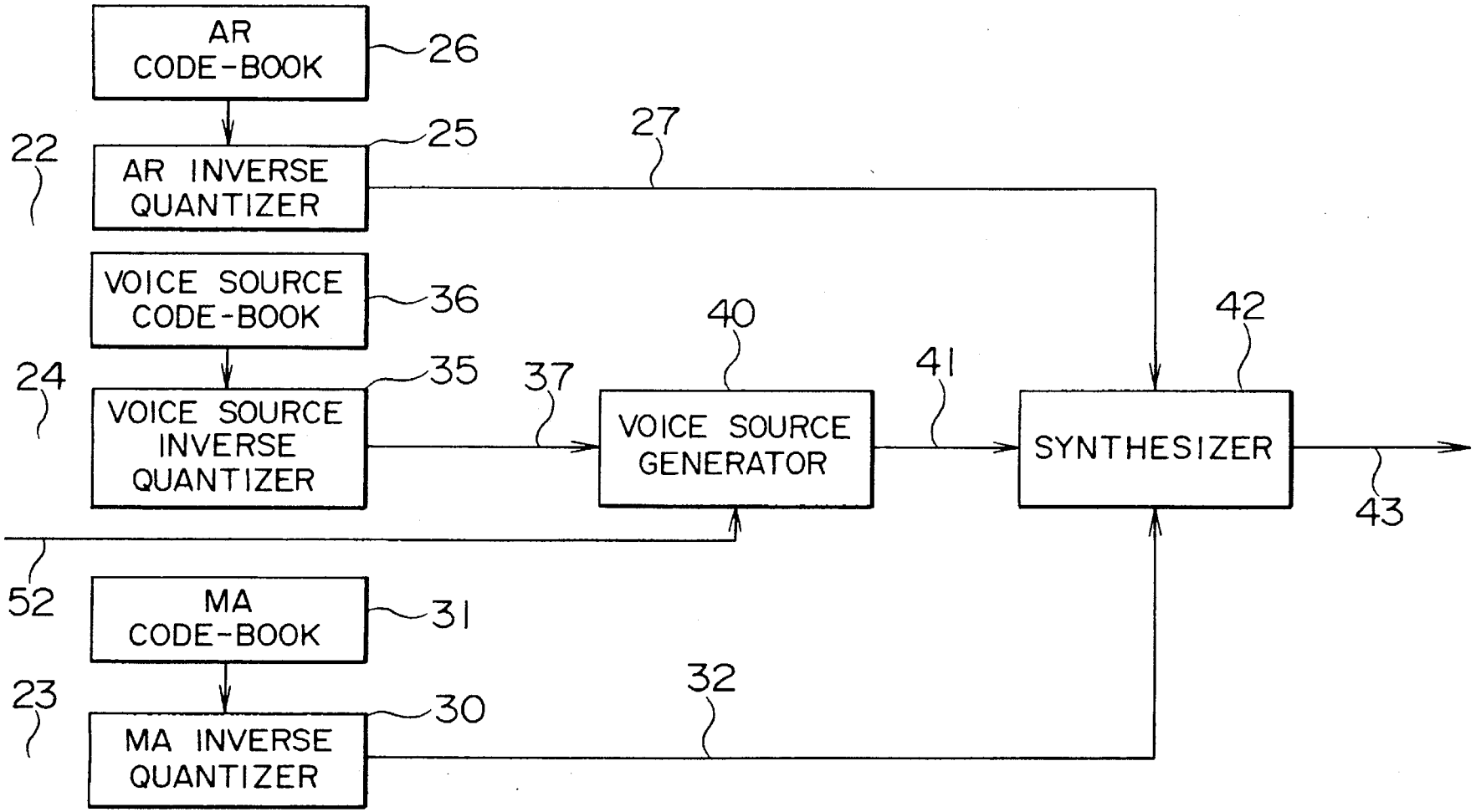

FIG. 6*b* is a block diagram showing the structure of the decoder unit coupled with the encoder unit of FIG. 6*a*, which is similar in structure and method of operation to the decoder of FIG. 2. However, the decoder unit of FIG. 6*b* lacks the AR interpolator 28, the MA interpolator 33, and the voice source interpolator 38 of FIG. 2. Further, the voice source generator 40 generates the voice source waveform 41 in response to the pitch period length 52 and the voice source code word 37 output from the voice source inverse quantizer 35. The speech synthesizer 42 produces the synthesized speech 43 on the basis of the AR code word 27 output from the AR inverse quantizer 25, the voice source waveform 41 output from the voice source generator 40, and the MA code word 32 output from the MA inverse quantizer 30. It is noted that the AR interpolator 28, the MA interpolator 33, and the voice source interpolator 38 of FIG. 2 may also be included in the decoder of FIG. 6*b*.

As described above, according to this invention, the input speech signal is encoded using voice source waveforms for each pitch period. Under this circumstance, the MA parameters serve to compensate for the inaccuracy of the voice source waveforms, especially when the pitch period becomes longer, such that the higher order MA parameters become necessary for accurate reproduction of the input speech signal. Thus, for the purpose of accurate and efficient encoding of the input speech signal, the order of the MA parameters should be varied depending on the length of the pitch period of the input speech signal. It is thus preferred that the degree or order q of the MA (the number of the MA parameters $b_j$'s excluding $b_0$ in the equation (1) above) is rendered variable.

Figure 7A:
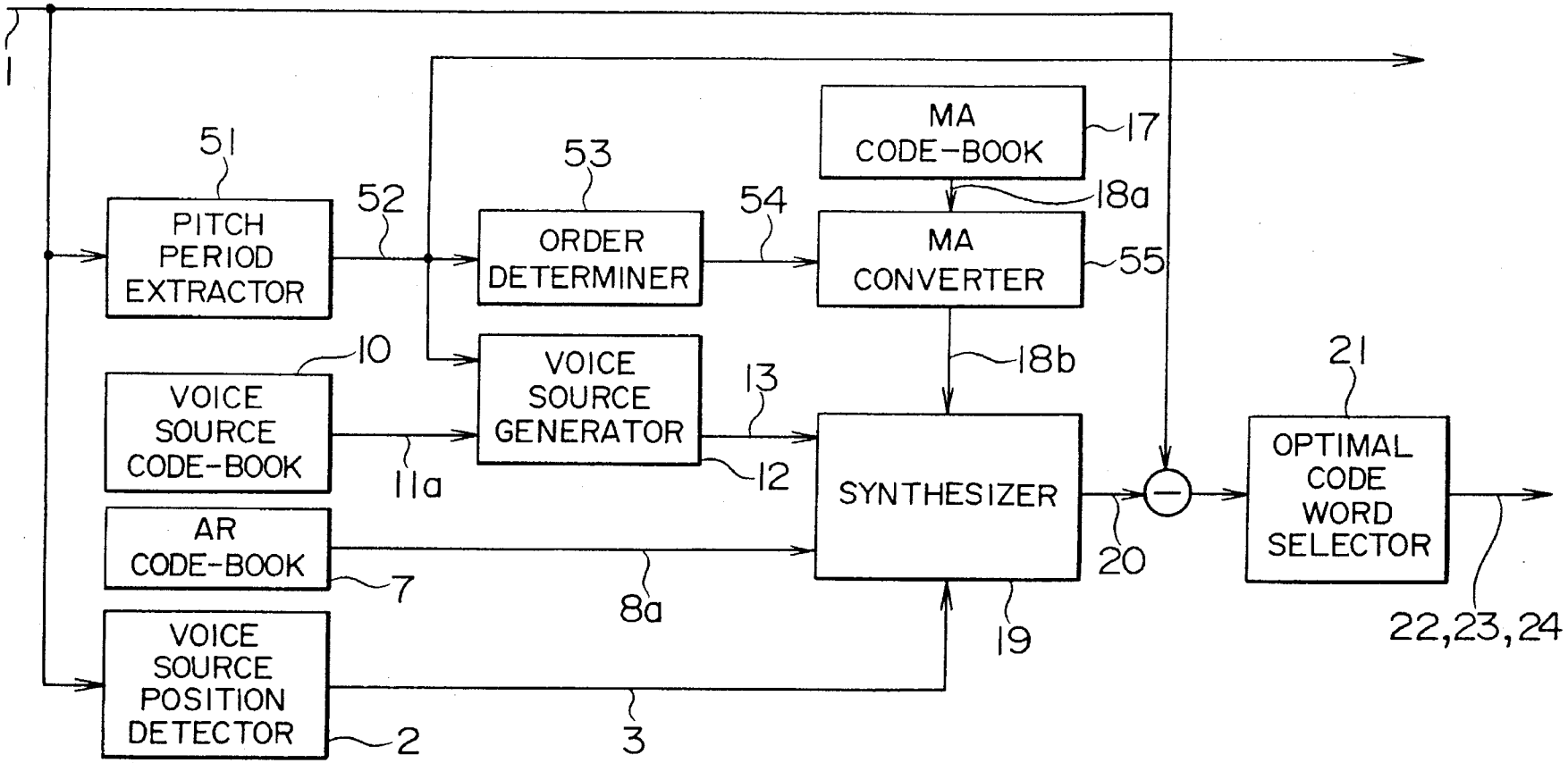

FIG. 7*a* is a block diagram showing the structure of the encoder unit of still another vocoder device according to this invention, by which the order of the MA parameters is varied in accordance with the pitch period of the input speech signal. Generally, the encoder of FIG. 7*a* is similar to that of FIG. 6*a*. However, the encoder unit of FIG. 7*a* further includes an order determiner 53 and an MA converter 55. The pitch period extractor 51 determines the pitch period of the input speech signal 1 and outputs the pitch period length 52 corresponding thereto. In response to the pitch period length 52 output from the pitch period extractor 51, the order determiner 53 determines the order 54 (the number q of the MA parameters $b_j$ excluding $b_0$) in accordance with the length of the pitch period of the input speech signal 1. For example, the order determiner 53 determines the order 54 as an integer closest to ¼ of the pitch period length 52.

The MA code-book 17 stores MA code words and the identification numbers corresponding thereto. The MA code words each consist, for example, of a set of cepstrum coefficients representing a spectral envelope. The MA code-book 17 outputs the MA code words 18*a* to the MA converter 55 together with the identification numbers thereof. The MA converter 55 converts the MA code words 18*a* into corresponding sets of MA parameters 18*b* of order q determined by the order determiner 53. The MA converter 55 effects the conversion using the equations:

$$C_n = b_n - \sum_{m=1}^{n-1} \frac{mC_m b_{n-m}}{n} \tag{3}$$

where Cn is the cepstrum parameter of the n'th order and $b_n$ is the n'th order MA coefficient (linear predictive analysis (LPC) coefficient).

The sets of the MA parameters 18*b* thus obtained by the MA converter 55 are output to the speech synthesizer 19 together with the identification numbers thereof. Otherwise, the encoder of FIG. 7*a* is similar to that of FIG. 6*b*.

Figure 7B:
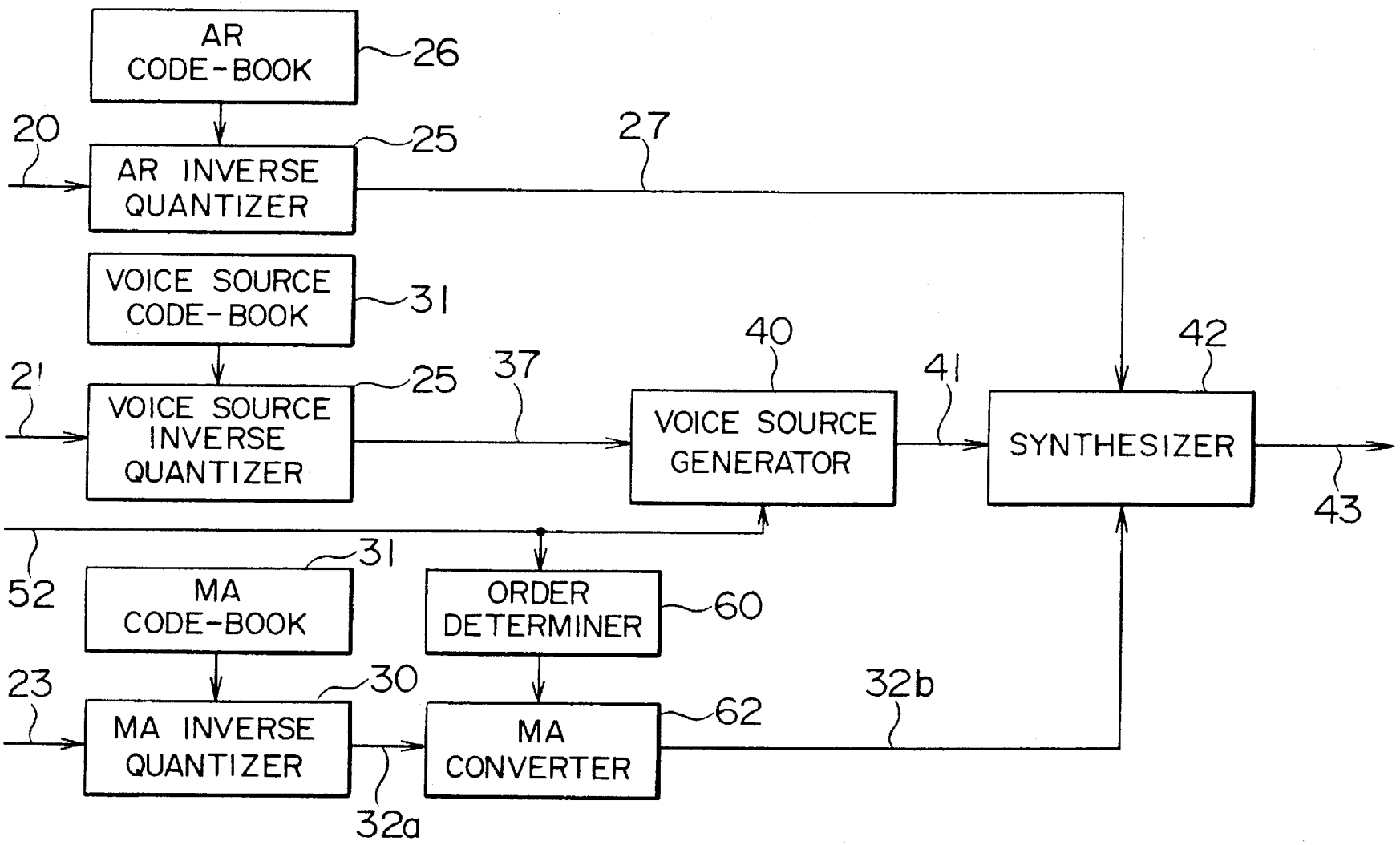
Figure 8A:
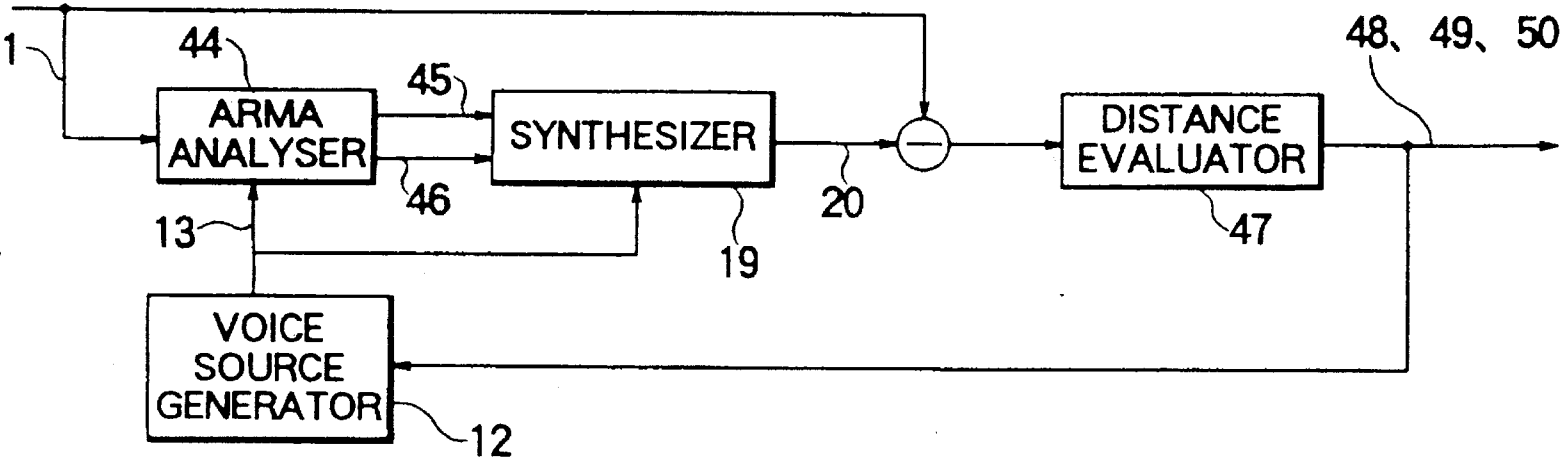
FIG. 8a (PRIOR ART)
Figure 8B:
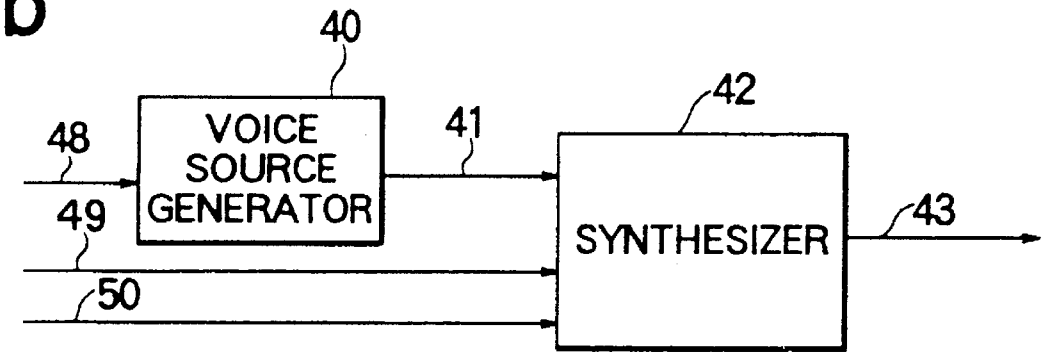
FIG. 8b (PRIOR ART)

FIG. 7*b* is a block diagram showing the structure of the decoder unit coupled with the encoder unit of FIG. 7*a*, which is similar in structure and method of operation to the decoder of FIG. 6*b*. However, the decoder of FIG. 7*b* includes an order determiner 60 which determines the order q of the MA parameters equal to the integer closest to the ¼ of the pitch period length 52 output from the pitch period extractor 51 of the encoder unit. The order determiner 60 outputs the order q 61 to the MA converter 62.

The MA code-book 31 is identical in organization to the MA code-book 17 and stores the same MA code words consisting of cepstrum coefficients. The MA inverse quantizer 30 retrieves the MA code word corresponding to the MA code word identification number 23 output from the optimal code word selector 21 and outputs it as the MA code word 32*a*. In response to the order q 61, the MA converter 62 converts the MA code word 32*a* into the corresponding MA parameters of order q, using the equation (3) above. The MA converter 62 outputs the converted MA parameters 32*b* to the speech synthesizer 42. Otherwise the decoder of FIG. 7*b* is similar to that of FIG. 6*b*.

As described above, the order q of the MA parameters is varied in accordance with the input speech signal 1. Thus, the distance or error between the input speech signal 1 and the synthesized speech 43 is minimized without sacrificing the efficiency, and the quality of the synthesized speech can thereby be improved.

In the embodiment of FIG. 7*b*, the decoder unit includes the order determiner 60 for determining the order of MA parameters in accordance with the pitch period length 52 received from the encoder unit. However, the optimal code word selector 21 of the encoder unit of FIG. 7*a* may select and output the order of MA parameters minimizing the error or distortion of the synthesized speech with respect to the input speech signal, and the order selected by the optimal code word selector 21 is supplied to the MA converter 62. Then the order determiner 60 of the decoder of FIG. 7*b* can be dispensed with.

Further, it is noted that the LSP and the PARCOR parameters may be used as the spectral envelope parameters of the MA code words. Furthermore, the order p of the AR parameters may also be rendered variable in a similar manner. Then, the LSP, the PARCOR, and the LPC cepstrum parameters may be used as the spectral envelope parameters of the AR code words. It is also noted that the AR preliminary selector 6, the voice source preliminary selector 9, and the MA parameters 15 of the embodiment of FIG. 1 may also be included in the embodiments of FIGS. 6*a* and 7*a* for optimizing the efficiency and accuracy of the speech reproduction.

What is claimed is:

1. A vocoder device for encoding and decoding speech signals, comprising:

an encoder unit for encoding an input speech signal including: (a) a first spectral code-book storing a plurality of spectral code words each corresponding to a set of spectral parameters and identified by a spectral code word identification number; (b) a first voice source code-book storing a plurality of voice source code words each representing a voice source waveform over a pitch period, the voice source waveform to be defined as the derivative of a glottal flow waveform and identified by a voice source code word identification number; (c) voice source generator means for generating voice source waveforms representative of the derivative of a glottal flow for each pitch period on the basis of said voice source code words; (d) speech synthesizer means for producing synthesized speech waveforms using the set of spectral parameters corresponding to said spectral code words to modify said voice source waveforms corresponding to said voice source code words in response to said spectral code words and said voice source waveforms; (e) optimal code word selector means including a subtractor receiving the input speech signal and the synthesized speech waveforms, and producing differences therebetween, for selecting a combination of a spectral code word and a voice source code word corresponding to a synthesized speech waveform having a smallest difference from said input speech signal, said optimal code word selector means outputting said spectral code word identification number and said voice source code word identification number corresponding to said spectral code word and said voice source code word, respectively, of said combination selected by said optimal code word selector means; and a decoder unit for reproducing a synthesized speech from each combination of said spectral code word and said voice source code word encoding said input speech signal, said decoder unit including: (f) a second spectral code-book identical to said first spectral code-book; (g) a second voice source code-book identical to said first voice source code-book; (h) spectral inverse quantizer means for selecting from said second spectral code-book a spectral code word corresponding to said spectral code word identification number; (i) voice source inverse quantizer means for selecting from said voice source code-book a voice source code word corresponding to said voice source code word identification number; (j) voice source generator means for generating a voice source waveform for each pitch period on the basis of said voice source code word selected by said voice source inverse quantizer; and (k) speech synthesizer means for producing a synthesized speech waveform on the basis of said spectral code word selected by said spectral inverse quantizer means and said voice source waveform generated by said voice source generator means.

2. A vocoder device as claimed in claim 1, wherein:

said encoder unit further includes: (l) pitch period extractor means for determining from said input speech signal a pitch period length value which denotes a time duration of a pitch period; (m) order determining means for determining an order defined as a number of parameters related to said pitch period length; and (n) first converter means for converting said spectral code words into corresponding spectral parameters, said spectral code words each consisting of a set of spectral envelope parameters corresponding to a set of said spectral parameters; and said decoder unit further includes: (o) second converter means for converting said spectral code word retrieved by said spectral inverse quantizer means from said second spectral code-book into a set of corresponding spectral parameters of an order equal to said order determined by said order determiner of said encoder unit.

3. A vocoder device for encoding and decoding speech signals, comprising:

an encoder unit for encoding an input speech signal for each analysis time frame equal to or longer than a pitch period of said input speech signal, including: spectrum analyzer means for analyzing said input speech signal and successively extracting therefrom a set of spectral parameters corresponding to a current spectrum of said input speech signal; a first spectral code-book storing a plurality of spectral code words each consisting of a set of spectral parameters and a spectral code word identification number corresponding thereto; spectral preliminary selector means for selecting from said spectral code-book a finite number of spectral code words representing sets of spectral parameters having smallest distances to said set of spectral parameters extracted by said spectrum analyzer means; a first voice source code-book storing a plurality of voice source code words each consisting of a set of voice source parameters representing a voice source waveform representative of the derivative of a glottal flow over a pitch period and a voice source code word identification number corresponding thereto; a voice source preliminary selector means for selecting a finite number of voice source code words having smallest distances to a voice source code word selected in a immediately preceding analysis time frame; voice source generator means for generating voice source waveforms representative of the derivative of a glottal flow for each pitch period on the basis of said voice source code words selected by said voice source preliminary selector; speech synthesizer means for producing synthesized speech waveforms for respective combinations of said spectral code words and said voice source code word; optimal code word selector means including means for comparing said synthesized speech waveforms with said input speech signal, and means for selecting a combination of a spectral code word and a voice source code word corresponding to a synthesized speech waveform having a smallest distance to said input speech signal, wherein said optimal code word selector outputting a combination of a spectral code word identification number corresponding to said spectral code word and a voice source code word identification number corresponding to said voice source code word, said combination of said spectral code word identification number and said voice source code word identification number encoding said input speech signal; and a decoder unit for reproducing a synthesized speech from each combination of said spectral code word identification number and said voice source code word identification number encoding said input speech signal, said decoder unit including: a second spectral code-book storing a plurality of spectral code words each consisting of a set of spectral parameters and a spectral code word identification number corresponding thereto, said second spectral code-book being identical to said first spectral code-book; a second voice source code-book storing a plurality of voice source code words each consisting of a set of voice source parameters representing a voice source waveform representing the derivative of a glottal flow over a pitch period and a voice source code word corresponding thereto, said second voice source code-book being identical to said first voice source code-book; spectral inverse quantizer means for selecting from said second spectral code-book a spectral code word corresponding to said spectral code word identification number; voice source inverse quantizer means for selecting from said voice source code-book a voice source code word corresponding to said voice source code word identification number; voice source generator means for generating a voice source waveform representing the derivative of a glottal flow for each pitch period on the basis of said voice source code word selected by said voice source inverse quantizer; and speech synthesizer means for producing a synthesized speech waveform on the basis of said spectral code word selected by said spectral inverse quantizer means and said voice source waveform generated by said voice source generator means.

4. A vocoder device as claimed in claim 3, wherein:

said spectrum analyzer means extracts a set of said spectral parameters for each analysis time frame longer than said pitch period; and said encoder unit further includes voice source position detector means for detecting a start point of said voice source waveform for each pitch period and outputting said start point as a voice source position; said voice source generator means generating said voice source waveforms in synchronism with said voice source position output from said voice source position detector means for each pitch period; said optimal code word selector means selecting a combination of said spectral code word and said voice source code word which minimizes said distance between said voice source position detector and said input speech signal over a length of time including pitch periods extended over a current frame and a preceding and a succeeding frame; and said decoder unit further includes: spectral interpolator means for outputting interpolated spectral parameters interpolating for each pitch period said spectral parameters of said spectral code words of current and preceding frames; voice source interpolator means for outputting interpolated voice source parameters interpolating for each pitch period said voice source parameters of said voice source code words of current and preceding frames; wherein said voice source generator generates said voice source waveform for each pitch period on the basis of said interpolated voice source parameters, and said speech synthesizer means producing said synthesized speech waveform for each pitch period on the basis of said interpolated spectral parameters and said voice source waveform output from said voice source generator.

5. A vocoder device for encoding and decoding speech signals, comprising:

an encoder unit for encoding an input speech signal including: (a) a first AR code-book storing a plurality of AR code words each corresponding to a set of AR parameters and identified by an autoregressive (AR) code word identification number; (b) a first moving average (MA) code-book storing a plurality of MA code words each representing a set of spectral envelope parameters corresponding to MA parameters and identified by a MA code word identification number; (c) pitch period extractor means for determining a pitch period length of said input speech signal; (d) order determining means for determining an order defined as a number of parameters related to said pitch period length; and (e) first converter means for converting said MA code words into corresponding MA parameters of said order determined by said order determining means; (f) a first voice source code-book storing a plurality of voice source code words each representing a voice source waveform over a pitch period and identified by a voice source code word identification number; (g) voice source generator means for generating voice source waveforms for each pitch period on the basis of said voice source code words; (h) speech synthesizer means for producing synthesized speech waveforms for respective combinations of said AR code words, MA code words and said voice source code word, in response to said AR code words, said MA parameters and said voice source waveforms; (i) optimal code word selector means including means for forming a difference between the synthesized speech signal and the input speech signal, and means for selecting a combination of an AR code word, an MA code word corresponding to said MA parameters, and a voice source code word corresponding to a synthesized speech waveform having a smallest difference from said input speech signal, said optimal code word selector means outputting said AR code word identification number, said MA code word identification number and said voice source code word identification number corresponding to said AR code word, said MA code word, and said voice source code word, respectively, of said combination selected by said optimal code word selector means;

a decoder unit for reproducing a synthesized speech from each combination of said AR code word and said voice source code word encoding said input speech signal, said decoder unit including: (j) a second AR code-book identical to said first AR code-book; (k) a second MA code-book identical to said first MA code-book; (1) a second voice source code-book identical to said first voice source code-book; (m) AR inverse quantizer means for selecting from said second AR code-book an AR code word corresponding to said AR code word identification number; (n) MA inverse quantizer means for selecting from said second MA code-book a MA code word corresponding to said MA code word identification number; (o) second converter means for converting said MA code word, retrieved by said MA inverse quantizer means from said MA code-book, into a set of corresponding MA parameters of an order equal to said order determined by said order determining of said encoder unit; (p) voice source inverse quantizer means for selecting from said voice source code-book a voice source code word corresponding to said voice source code word identification number; (q) voice source generator means for generating a voice source waveform for each pitch period on the basis of said voice source code word selected by said voice source inverse quantizer; and (r) speech synthesizer means for producing a synthesized speech waveform on the basis of said AR code word selected by said AR inverse quantizer means, said MA parameters obtained by said second converter means and said voice source waveform generated by said voice source generator means.

6. In a vocoder device for encoding and decoding speech signals, an encoder unit for encoding an input speech signal comprising:

(a) a first spectral code-book storing a plurality of spectral code words each corresponding to a set of spectral parameters and identified by a spectral code word identification number;

(b) a first voice source code-book storing a plurality of voice source code words each representing a voice source waveform representative of the derivative of a glottal flow over a pitch period and identified by a voice source code word identification number;

(c) a voice source generator means for generating voice source waveforms representative of the derivative of a glottal flow for each pitch period on the basis of said voice source code words;

(d) a speech synthesizer means for producing synthesized speech waveforms using the set of spectral parameters corresponding to said spectral code words to modify said voice source waveforms corresponding to said voice source code words in response to said spectral code words and said voice source waveforms; and (e) an optimal code word selector means including means for forming a difference between the synthesized speech signal and the input speech signal, and means for selecting a combination of a spectral code word and a voice source code word corresponding to a synthesized speech waveform having a smallest difference from said input speech signal, said optimal code word selector means outputting said spectral code word identification number and said voice source code word identification number corresponding to said spectral code word and said voice source code word, respectively, of said combination selected by said optimal code word selector means.

7. In a vocoder device for encoding and decoding speech signals, a decoder unit for reproducing a synthesized speech signal from a combination of a spectral code word identification number and a voice source code word identification number resulting from encoding an input speech signal, said decoder unit including:

(a) a spectral code-book for storing a plurality of spectral code words each corresponding to a set of spectral parameters and identified by a spectral code word identification number; (b) a voice source code-book for storing a plurality of voice source code words each representing a voice source wave form over a pitch period, the voice source waveform defined as the derivative of a glottal flow waveform and identified by a voice source code word identification number;

(c) a spectral inverse quantizer means for selecting from said spectral code-book a spectral code word corresponding to said received spectral code word identification number;.

(d) a voice source inverse quantizer means for selecting from said voice source code-book a voice source code word corresponding to said received voice source code word identification number;

(e) voice source generator means for generating a voice source waveform representative of the derivative of a glottal flow for each pitch period on the basis of said voice source code word selected by said voice source inverse quantizer; and (f) speech synthesizer means for producing a synthesized speech waveform using the set of spectral parameters corresponding to said spectral code word selected by said spectral inverse quantizer means to modify said voice source waveform generated by said voice source generator means.

8. A vocoder device as claimed in claim 7, wherein said decoder unit further includes:

a spectral interpolator means for outputting interpolated spectral parameters, interpolated from said spectral code word selected by said spectral inverse quantizer means over a length of time including pitch periods of a current time frame and a preceding time frame;

a voice source interpolator means for outputting interpolated voice source parameters interpolated from said voice source code words from said voice inverse quantizer means, for each pitch period of said current time frame and said preceding time frame, and wherein said voice source generator generates said voice source waveform for each pitch period on the basis of said interpolated voice source parameters, and said speech synthesizer means produces said synthesized speech waveform for each pitch period on the basis of said interpolated spectral parameters and said voice source waveform output from said voice source generator.

9. A vocoder device as claimed in claim 7, wherein, said decoder unit further includes:

(a) a second order determining means responsive to the input signal for determining an order defined as a number of parameters comprising a set of the spectral parameters closest to the pitch period length of the input signal; and (b) a converter means for converting said spectral code word retrieved by said spectral inverse quantizer means from said spectral code-book into a set of corresponding spectral parameters having an order equal to the order determined by the second order determining means.

10. In a vocoder device for encoding and decoding speech signals, an encoder unit for encoding an input speech signal for each analysis time frame equal to or longer than a pitch period of said input speech signal, including:

a spectrum analyzer means for analyzing said input speech signal and successively extracting therefrom a set of spectral parameters corresponding to a current spectrum of said input speech signal;

a spectral code-book storing a plurality of spectral code words each consisting of a set of spectral parameters and a spectral code word identification number corresponding thereto;

a spectral preliminary selector means for selecting from said spectral code-book a finite number of spectral code words representing sets of spectral parameters having smallest distances to said set of spectral parameters extracted by said spectrum analyzer means;

a voice source code-book storing a plurality of voice source code words each consisting of a set of voice source parameters representing a voice source waveform over a pitch period, the voice source waveform defined as the derivative of a glottal flow waveform and a voice source code word identification number corresponding thereto;

a voice source preliminary selector means for selecting a finite number of voice source code words having smallest distances to a voice source code word selected in an immediately preceding analysis time frame;

a voice source generator means for generating voice source waveforms representative of the derivative of a glottal flow for each pitch period on the basis of said voice source code words selected by said voice source preliminary selector;

a speech synthesizer means for producing synthesized speech waveforms using the set of spectral parameters corresponding to said spectral code words to modify said voice source waveforms corresponding to said voice source code word; and an optimal code word selector means including means for comparing said synthesized speech waveforms with said input speech signal, and means for selecting a combination of a spectral code word and a voice source code word corresponding to a synthesized speech waveform having a smallest distance to said input speech signal, wherein said optimal code word selector outputs a combination of a spectral code word identification number corresponding to said spectral code word and a voice source code word identification number corresponding to said voice source code word, said combination of said spectral code word identification number and said voice source code word identification number encoding said input speech signal.

11. A vocoder device as claimed in claim 10, wherein said spectrum analyzer means extracts a set of said spectral parameters for each analysis time frame longer than said pitch period, and wherein said encoder unit further includes:

a voice source position detector means for detecting a start point of said voice source waveform representative of the derivative of a glottal flow for each pitch period and outputting said start point as a voice source position; and wherein said voice source generator means includes means responsive to said voice source position detector means for generating said voice source waveforms representative of the derivative of a glottal flow in synchronism with said voice source position output from said voice source position detector means for each pitch period; and wherein said optimal code word selector means includes means responsive to a difference signal representing a difference between said synthesizer and said input speech signal, for selecting a combination of said spectral code word and said voice source code word which minimizes the distance between said voice source position detector and said input speech signal over a length of time including pitch periods extended over a current frame and a preceding and succeeding time frame.

12. A vocoder device as claimed in claim 10, wherein, said encoder unit further includes:

(a) a pitch period extractor means for determining a pitch period length of said input speech signal;

(b) an order determining means for determining an order defined as a number of parameters related to said pitch period length; and (c) a converter means for converting said spectral code words, from said spectral-code book, into corresponding spectral parameters of the order determined by said order determining means, said spectral code words each consisting of a set of spectral envelope parameters and corresponding to said set of spectral parameters.

13. A vocoder device for encoding and decoding speech signals, comprising an encoder unit for encoding an input speech signal including:

(a) an autoregressive (AR) code-book storing a plurality of AR code words each corresponding to a set of AR parameters and identified by an AR code word identification number;

(b) a moving average (MA) code-book storing a plurality of MA code words each representing a set of spectral envelope parameters corresponding to MA parameters and identified by a MA code word identification number;

(c) a pitch period extractor means for determining a pitch period length of said input speech signal;

(d) an order determining means for determining an order defined as a number of parameters related to said pitch period length; and (e) a converter means for converting said MA code words into corresponding MA parameters of said order determined by said order determiner means;

(f) a voice source code-book storing a plurality of voice source code words each representing a voice source waveform over a pitch period and identified by a voice source code word identification number;

(g) voice source generator means for generating voice source waveforms for each pitch period on the basis of said voice source code words;

(h) a speech synthesizer means for producing synthesized speech waveforms for respective combinations of said AR code words, said MA code words and said voice source code words, in response to said AR code words, said MA parameters and said voice source waveforms;

(i) optimal code word selector means including means for forming a difference between the synthesized speech signal and the input speech signal, and means for selecting a combination of an AR code word, an MA code word corresponding to said MA parameters, and a voice source code word corresponding to a synthesized speech waveform having a smallest difference from said input speech signal, said optimal code word selector means outputting said AR code word identification number, said MA code word, and said voice source code word, respectively, of said combination selected by said optimal code word selector means.

14. In a vocoder device for encoding and decoding speech signals, a decoder unit for reproducing a synthesized speech signal from a combination of an AR code word and a voice source code word representing an encoded input speech signal, said decoder unit including:

(a) an autoregressive (AR) code-book storing a plurality of AR code words each corresponding to a set of parameters and identified by an AR code word identification number;

(b) a moving average (MA) code-book for storing a plurality of MA code words each representing a set of spectral envelope parameters corresponding to MA parameters and identified by an MA code word identification number;

(c) a voice source code-book for storing a plurality of voice source code words each representing a voice source wave form over a pitch period and identified by a voice source code word identification number;

(d) an AR inverse quantizer means for selecting from said AR code-book an AR code word corresponding to said AR code word identification number;

(e) an MA inverse quantizer means for selecting from said MA code-book a MA code word corresponding to said MA code word identification number;

(f) an order determining means responsive to the input signal for determining an order defined as a number of parameters comprising a set of MA spectral parameters closest to the pitch period length of the input signal;

(g) a converter means for converting said MA code word, retrieved by said MA inverse quantizer means from said MA code-book, into the set of corresponding MA parameters of the order determined by the order determiner means;

(h) a voice source inverse quantizer means for selecting from said voice source code-book a voice source code word corresponding to said voice source code word identification number;

(i) a voice source generator means for generating a voice source waveform for each pitch period on the basis of said voice source code word selected by said voice source inverse quantizer; and (j) speech synthesizer means for producing a synthesized speech waveform on the basis of said AR code word selected by said AR inverse quantizer means, said MA parameters obtained by said MA converter means and said voice source waveform generated by said voice source generator means.

15. A vocoder device, for processing an input signal, comprising:

an encoder unit and a decoder unit;

the encoder unit including a first spectral code-book storing a plurality of spectral code words, each spectral code word corresponding to a set of spectral parameters;

a first voice source code-book storing a plurality of voice source code words, each voice source code word corresponding to one pitch period duration of a voice source waveform;

a first voice source generator connected to receive voice source code words from the first voice source code-book, for generating the voice source waveforms represented thereby;

a first synthesizer connected to receive the voice source waveforms generated by the voice source generator and to receive spectral code words from the first spectral code-book, for synthesizing voice waveforms from the voice source waveforms modified by the spectral code words;

a subtractor receiving the input signal and the synthesized voice waveforms and producing a difference signal; and an optimal code word selector, receiving the difference singal and selecting for an encoder unit output a voice source code word and a spectral code word which produce a smallest difference signal; and the decoder unit including a second spectral code-book having identical contents to the first spectral code-book;

a second voice source code-book having identical contents to the first voice source code-book;

means for selecting a spectral code word corresponding to the encoder unit output from the second spectral code-book;

means for selecting a voice source code word corresponding to the encoder unit output from the second voice source code-book;

a second voice source generator receiving the selected voice source code word and generating a voice source waveform correspsonding thereto; and a second synthesizer receiving the generated voice source waveform and the selected spectral code word, and producing a voice waveform therefrom.

16. The vocoder device of claim 15, the encoder further comprising:

a pitch period extractor connected to receive the input signal and producing a pitch period output indicative of a time duration of a pitch period;

the first voice source generator connected to receive the pitch period output of the pitch period extractor, to generate the voice source waveforms at the extracted pitch period; and a first order determiner for determining a number of spectral parameters to represent the input signal; and the decoder further comprising;

a second order determiner for determining from the encoder output the number of spectral parameters representing the input signal; and a converter receiving the spectral code words from the spectral code-book and the number of spectral parameters representing the input signal and producing the spectral code words received by the second synthesizer.

17. The vocoder of claim 15, wherein the spectral code-books each further comprise:

an autoregressive (AR) code-book holding AR code words representing AR parameters; and a moving average (MA) code-book holding MA code words representing MA parameters.

18. The vocoder of claim 15, wherein the decoder further comprises:

a spectral code word interpolator for interpolating spectral parameters, the spectral code word interpolator connected between the second spectral code-book and the second synthesizer; and a voice source code word interpolator for interpolating voice source parameters, the voice source code word interpolator connected between the second voice source code-book and the second voice source generator.

19. A method of encoding and decoding speech signals, comprising the steps of:

receiving an input signal;

storing in first and second spectral code-books a plurality of spectral code words corresponding to sets of spectral parameters;

storing in first and second voice source code-books a plurality of voice source code words, each corresponding to one pitch period duration of a voice source waveform;

generating a voice source waveform from a voice source code word stored in the first voice source code-book;

synthesizing a voice waveform from the voice source waveform generated, modified by a spectral code word from the first spectral code-book;

subtracting the synthesized voice waveform and the input waveform to form a difference therebetween; and selecting a combination of voice source code word and spectral code word producing a minimum difference; and selecting a spectral code word and a voice source code word from the second code-books;

selecting a spectral code word and a voice source code word from the second code-books;

generating a second voice source waveform from the voice source code word selected; and synthesizing an output speech signal from the second voice source waveform modified by the spectral code word selected from the second spectral code-book.

* * * * *